United States Patent [19]

Flamand

[11] 3,960,183

[45] June 1, 1976

[54] INTERCHANGEABLE WEFT CARRIER

[75] Inventor: Maurice Flamand, Cumberland, R.I.

[73] Assignee: Rockwell International Corporation, Pittsburgh, Pa.

[22] Filed: Feb. 3, 1975

[21] Appl. No.: 546,215

[52] U.S. Cl. ..... 139/447

[51] Int. Cl.[2] ..... D03D 47/22

[58] Field of Search ..... 139/122 R, 122 N, 122 W, 139/127 R

[56] References Cited

UNITED STATES PATENTS

| | | | |
|---|---|---|---|
| 3,025,886 | 3/1962 | Villani | 139/122 N |
| 3,842,867 | 10/1974 | Volpe | 139/122 N |
| 3,874,420 | 4/1975 | Cugini | 139/122 N |

*Primary Examiner*—Henry S. Jaudon

[57] ABSTRACT

This invention relates to shuttleless looms and more particularly to an improved carrier for use on a loom of the shuttleless type where the weft yarn is supplied from a stationary source located outside of the warp.

2 Claims, 5 Drawing Figures

INTERCHANGEABLE WEFT CARRIER

BACKGROUND OF THE INVENTION

In shuttleless looms, that is, those looms in which weft yarn is supplied from a stationary source location outside the lateral limits of the warp yarns, it is customary to insert each pick of weft by means of a reciprocating inserter or inserters. In the most common shuttleless operation a supply of weft is located adjacent the right hand side of the loom and each pick is drawn from the source and inserted into the shed formed between the warp yarns. The insertion itself is effected by means of an inserted carrier which is moved into and from the shed by means of a reciprocating inserter. In this usual form the inserter carrier is met at approximately the center of the warp shed by an extending carrier which grasps the end of the weft being inserted and draws it to the other side of the loom. The extending carrier is moved into and out of the shed by means of a reciprocating inserter in the same manner in which the inserter carrier is moved.

Although shuttleless looms as initially constructed and operated utilized only a single source of weft yarn and were therefore limited to one weft color, diverse types of method and apparatus were developed which ultimately made it possible to effect the insertion of weft yarn drawn from a plurality of sources. After utilization of a plurality of sources became a practical possibility it could be seen that a number of significant alterations in the structural features of certain ancillary parts of the basic weaving machine had been required. For example, when weft yarn was withdrawn from a plurality of yarn packages methods had to be devised to insure that each of the yarns to be inserted was at some position along its length, located at exactly the same point so that the inserting carrier would always engage it during its inward movement into the shed. Additionally, when utilizing only a single source, the inserted weft yarn could be threaded through a completely closed guide in the inserter carrier, since at no time was that yarn ever completely removed from its carrier. In contradistinction, when weft is drawn from a plurality of sources each weft yarn must be capable of being removed completely from the inserting carrier when yarn from a different source is to be inserted. Of course, when a loom that had been weaving with weft from a single source was to be converted to utilize yarn from a plurality of sources it was necessary to effect complete changes in the inserter carrier system. A similar change was required when converting from multiple to single pick insertion.

Therefore, a principle object of this invention is to provide an improved inserter carrier in which a portion of the carrier can be altered to accommodate the insertion of weft yarn from one or from a plurality of outside sources.

An additional object of this invention is to provide an improved inserter carrier in which a yarn guiding back plate can be easily removed and replaced with one suitable for the insertion of weft yarn from a single source or from a plurality of sources, depending upon the function of the plate being removed.

Other objects and advantages of this invention will be in part obvious and in part explained by reference to the accompanying specification and drawings in which:

DESCRIPTION OF THE INVENTION

Figure 1:
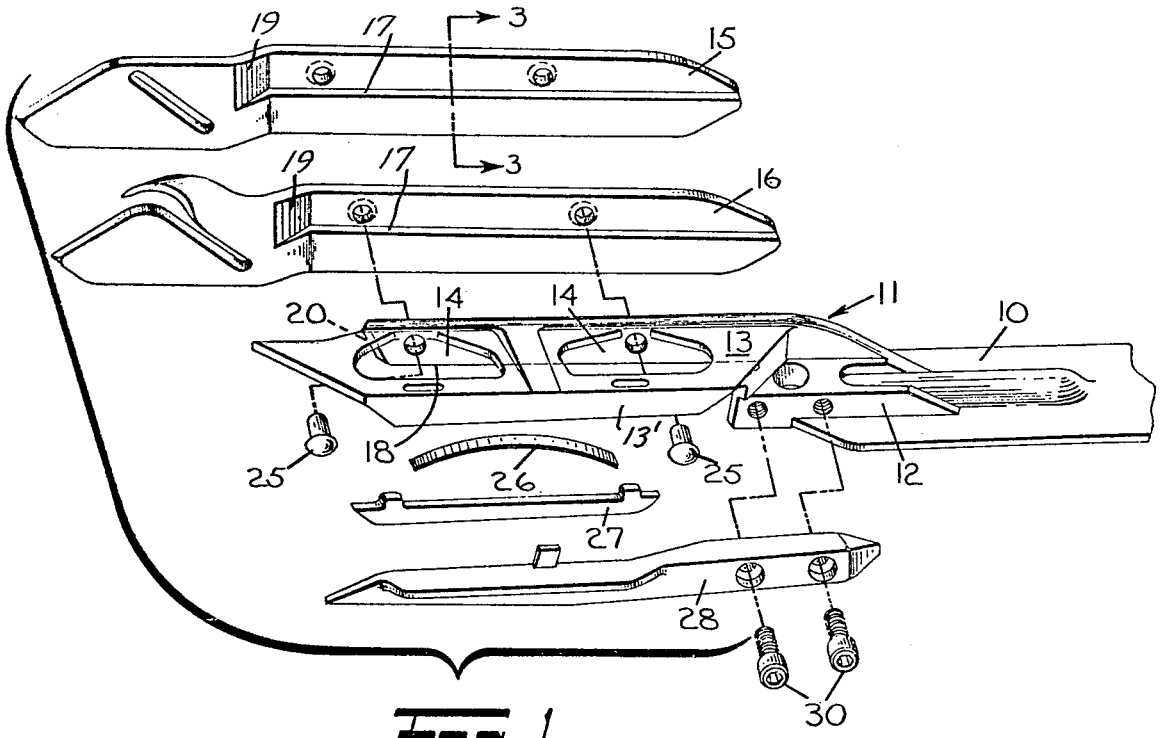
FIG. 1 is an exploded perspective view of a carrier constructed in accordance with the invention, showing alternate backplates, and also showing the inserter to which the carrier is attached.

For a better understanding of the invention, reference is made to the drawings and particularly to FIG. 1. In this figure the numeral 10 indicates a reciprocating inserter which is here shown in the form of a flat tape. This type of inserter is widely and commonly used in shuttleless looms and is a flexible element that is wrapped and unwrapped about the periphery of a reciprocating tape wheel that is located on the side of loom. Other types of inserters are also used, such as rigid rods and telescoping members, but the particular type of inserter used is not important to this invention.

At the lefthand most end of inserter 10 (as viewed in FIG. 1) the carrier is shown as comprising a main body portion 11. Body portion 11 is itself made up of a shank portion 12 a horizontally extending upper wall 13 and a wall 14 which extends substantially vertically downward from the horizontal wall 13. It can be seen that the vertically extending wall 14 extends outwardly away from the inserter 10 and the shank portion 12 and that it is disposed substantially normal to the broad dimension of inserter 10. Additionally it can be seen that the generally horizontally extending upper wall 13 extends outwardly from the upper edge of wall 14 and is provided on the forward side thereof with a depending lip 13'. Upper wall 13 lies in a plane that is substantially parallel to the plane containing tape 10.

Figure 2:
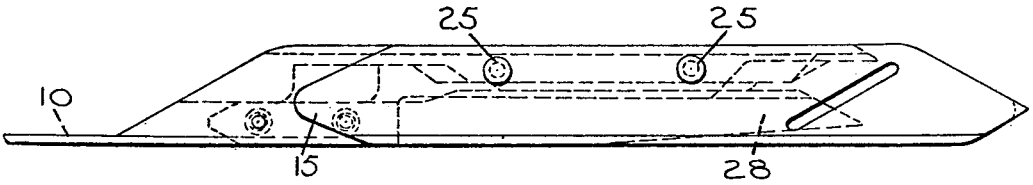
FIG. 2 is a side elevation of the carrier of FIG. 1 looking in the direction of the backplate.

In order to control or guide the weft yarn to be inserted, means must be provided for contacting the weft as it is being drawn from the source and inserted into the warp shed. Depending upon whether or not weft is to be drawn from a single or from a plurality of sources, one or the other of the backplates 15 and 16 will be required. If a plurality of sources is to be used, then backplate 16 would be mounted on the main body portion 11 whereas if only a single source was to be utilized then the backplate 15 would be assembled to the main body portion. The manner in which element 15 is secured to the main body portion 11 is shown in FIG. 2 of the drawings.

Figure 3:
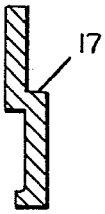
FIG. 3 is a cross-sectional view taken along the lines 3—3 of the backplate shown in FIG. 1.
Figure 5:
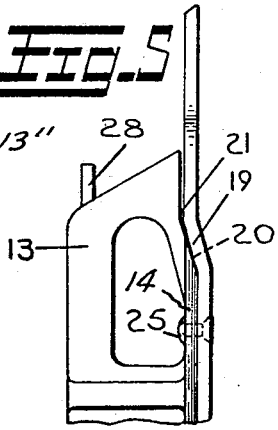
FIG. 5 is a top elevation of a portion of the assembled inserter of FIG. 2.

It should be noted that the vertically extending wall 14 of the main body portion 11 and the backplate 15, 16, include means which interfit to provide vertical and longitudinal support between these elements of the carrier structure. Specifically, as best seen in FIG. 3, the backplates 15 and 16 are constructed with an offset that provides a substantially horizontal shoulder 17 and that this shoulder will interfit or mate with the lower edge 18 of the vertically extending wall 14. Similarly each of the backplates is provided with an offset portion 19 (see FIG. 5) that will interfit with the leading edge 20 of vertical wall 14 as well as with a mating surface 21 on the horizontally extending wall 13. By reason of these contacting surfaces there is provided both vertical and longitudinal support between the backplates and the walls of the main body portion 11 that reduce the strains imposed on the means which secure the backplates 15 and 16 to the main body portion.

As shown in the figures of the drawings small fastening elements 25 have been provided to act as the means for assembling the backplates 15 and 16 on the vertically extending wall 14. These fasteners may advantageously be rivets or other readily removable fasteners that provide for easy attachment and detachment between backplates 15 or 16 and wall 14.

Figure 4:
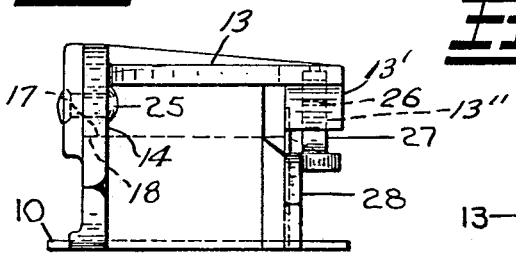
FIG. 4 is a front elevation of the assembled carrier of FIG. 2.

Also shown in exploded perspective in FIG. 1 is the gripping means which holds the end of the weft yarn that is being inserted into the shed. This means comprises a spring 26, a spring mounting element 27 and a yarn finger 28 through which it is possible to adjust the tension that grips the yarn being inserted. As best shown in FIG. 1 the elements 26, 27 and 28 interfit and are held in position by means of fasteners 30 that thread into the shank portion 12 of the main body 11. In FIG. 4 the elements of the gripping means are shown in assembled position in which the yarn finger 28 forms the lower forward side of the carrier with the spring 26 and spring mounting element 27 located intermediate the upper surface of said yarn finger 28 and a recess 13'' formed on the underside of the depending lip 13'. The lower surface of the spring mounting element 27 is continually urged downwardly by spring 26 into contact with the upper surface of the yarn finger 28 to form the weft gripping means all of which is well known to those conversant in the art.

Whereas, in previously existing yarn inserters it was necessary to completely change the inserting system or at the very least to completely remove an entire carrier from its associated inserter. It now becomes possible to effect a change from a multiple to a single supply source, or vice versa, merely by removing the two fastening elements 25 and merely replacing the backplate of one type with one of a different type.

Although the present invention has been described in connection with preferred embodiments, it is to be understood that modifications and variations may be resorted to without departing from the spirit and scope of the invention as those skilled in the art will readily understand. Such modifications and variations are considered to be within the purview and scope of the invention and the appended claims.

I claim:

1. An improved carrier for inserting weft yarn into the shed formed between warp yarns on a loom of the type in which the weft yarn is supplied from a source located outside of the warp and is inserted into the shed by a carrier which is attached to a reciprocating inserter, said improved carrier comprising a main body portion including (a) a shank portion for attached to the inserter, (b) a generally horizonally extending upper wall and (c) at least one additional wall which extends substantially vertically, a weft yarn guiding backplate disposed adjacent said vertically extending wall of said main body portion, fastening means for securing said backplate to said vertically extending wall, and gripping means assembled on said main body portion for holding the end of the weft yarn being inserted.

2. An improved carrier as defined in claim 1 wherein said vertically extending wall of said main body portion and said weft yarn guiding backplate include means which interfit to provide vertical and longitudinal support therebetween.

* * * * *